US007287674B1

(12) United States Patent
Sutton et al.

(10) Patent No.: US 7,287,674 B1
(45) Date of Patent: Oct. 30, 2007

(54) GARMENT HANGER SYSTEM WITH SIZE INDICATOR

(75) Inventors: Steven Sutton, Deal, NJ (US); John G. Warmath, Humboldt, TN (US)

(73) Assignee: The Accessory Corp., New York, NY (US)

( * ) Notice: Subject to any disclaimer, the term of this patent is extended or adjusted under 35 U.S.C. 154(b) by 324 days.

(21) Appl. No.: 10/925,682

(22) Filed: Aug. 25, 2004

(51) Int. Cl.
*A41D 27/22* (2006.01)

(52) U.S. Cl. ..... 223/85; 223/92; 40/322

(58) Field of Classification Search ..... 223/85, 223/87, 88, 92, 95, 96, 97, 98; 206/281; 211/113; 248/339, 340; 40/322
See application file for complete search history.

(56) References Cited

U.S. PATENT DOCUMENTS

| | | | | | |
|---|---|---|---|---|---|
| 1,447,083 | A | * | 2/1923 | Jonas | 223/96 |
| 1,575,775 | A | * | 3/1926 | Lesser | 40/322 |
| 2,690,863 | A | * | 10/1954 | Adelman | 40/322 |
| 3,535,808 | A | * | 10/1970 | Morrish | 40/322 |
| 3,790,044 | A | * | 2/1974 | Verdile | 223/86 |
| 3,898,754 | A | * | 8/1975 | Johansson | 40/322 |
| 4,017,990 | A | | 4/1977 | Garrison | 40/322 |
| 4,045,899 | A | * | 9/1977 | Richardson | 40/322 |
| 4,123,864 | A | * | 11/1978 | Batts et al. | 40/322 |
| 4,160,333 | A | | 7/1979 | Indelicato | 40/322 |
| 4,187,967 | A | | 2/1980 | Garrison | 223/92 |
| 4,198,773 | A | | 4/1980 | Batts et al. | 40/322 |
| 4,322,902 | A | | 4/1982 | Lenthall | 40/322 |
| 4,333,590 | A | * | 6/1982 | Princiotta | 223/85 |
| 4,679,340 | A | * | 7/1987 | Johansson | 40/322 |
| 4,881,836 | A | * | 11/1989 | Blanchard | 40/322 |
| 5,056,248 | A | * | 10/1991 | Blanchard | 40/322 |
| 5,289,956 | A | * | 3/1994 | Petrou | 223/85 |
| 5,388,354 | A | | 2/1995 | Marshall et al. | 40/322 |
| 5,477,995 | A | | 12/1995 | Dooley et al. | 223/85 |
| 4,322,902 | A | | 1/1996 | Lenthall | 40/322 |
| 5,499,466 | A | | 3/1996 | House | 40/322 |
| 5,586,697 | A | | 12/1996 | Johansson | 223/85 |
| 5,603,437 | A | | 2/1997 | Zuckerman | 223/85 |
| 5,664,708 | A | | 9/1997 | Sacks | 223/85 |
| 5,687,887 | A | | 11/1997 | Bond et al. | 223/85 |
| D393,371 | S | | 4/1998 | Dunn | D6/328 |
| 5,819,995 | A | | 10/1998 | Zuckerman | 223/85 |
| 5,857,276 | A | | 1/1999 | Marshall et al. | 40/322 |
| 6,019,261 | A | * | 2/2000 | Morgan et al. | 223/96 |
| 6,189,746 | B1 | | 2/2001 | Gouldson | 223/85 |
| 6,378,744 | B2 | | 4/2002 | Olk et al. | 223/85 |

* cited by examiner

*Primary Examiner*—Gary L. Welch
*Assistant Examiner*—Nathan E Durham
(74) *Attorney, Agent, or Firm*—Gordon & Jacobson, PC

(57) ABSTRACT

A garment hanger system including a hook member, a hanger body and an information indicator mounted on the hanger body. The hanger body includes a reinforcing rib section disposed adjacent a mounting structure that receives the hook member. The information indicator is adapted to mount around the hook member and detachably interlock with the reinforcing rib section. The information indicator includes one or more walls defining a top opening and a hollow cavity. Preferably, the end of the hook member passes through the top opening such that the indictor can slide down the hook member. The sidewalls of the indicator are preferably adapted, for example, with locking nibs, to detachably interlock to the reinforcing rib section of the hanger body.

13 Claims, 6 Drawing Sheets

GARMENT HANGER SYSTEM WITH SIZE INDICATOR

BACKGROUND OF THE INVENTION

1. Field of the Invention

This invention relates broadly to garment hangers. More particularly, this invention relates to garment hangers with size indicators affixed thereto.

2. State of the Art

To accommodate garments supported by hangers in an orderly manner, it has become commonplace to affix an indicator (commonly referred to as a "sizer") to the garment hanger. The indicator identifies some attribute of the supported garment which is typically the size, although quantity, color, or other attribute can be identified. To accommodate various types of hangers available in the industry, numerous indicators have been developed in a variety of sizes and shapes. In addition, to avoid the risk of injury to a child that may possibly tamper with the hanger and choke on the indicator, numerous mounting arrangements have been developed that are resistant to such tampering, yet provide for removal of the indicator and thus reuse of the hanger.

Most of the sizers actually utilized in the art are known as "top-sizers" or "side-sizers" and are provided in conjunction with plastic webs provided on plastic hangers. Top-sizers are typically used on hangers having integral plastic hooks with webs extending from the top of the hook as shown, e.g., in U.S. Pat. No. 5,388,354 to Marshall et al., U.S. Pat. No. 5,603,437 to Zuckerman, and U.S. Pat. No. 5,857,276 to Marshall et al. Side-sizers, likewise are used on hangers having integral plastic hooks with the web extending between the plastic hook and the hanger cross-bar as shown, e.g., in U.S. Pat. No. 5,819,995 to Zuckerman, U.S. Pat. No. 6,189,746 to Gouldson, and U.S. Pat. No. 6,378,744 to Olk et al.

While it would also be desirable to provide sizers on hangers utilizing metal hooks, to date, commercially, such sizers have not been successful. Some such sizers have been proposed. For example, U.S. Pat. No. 4,198,773 to Batts et al. discloses a sizer system for a hanger that has a header portion which receives a metal hook. An annular boss extends from the header portion of the hanger and receives the metal hook. The indicator (tally) is passed over the hook and fitted over the annular boss utilizing an interference fit. This interference fit enables the indicator to be removeably attached to the header portion to provide for reuse of the hanger. However, this interference fit is difficult to control and thus does not provide adequate resistance to tampering, and thus poses child-safety issues.

In another example, U.S. Pat. No. 5,687,887 to Bond et al. discloses a side-sizer system for a hanger that has a plastic body which receives a metal hook. A support post extends from the body and receives the metal hook. The size indicator is fitted over a mounting rib that extends between the top of the hanger body and the support post. The size indicator is removed by a special tool, and thus is resistant to child tampering yet provides for reuse of the hanger. However, the structure of the mounting rib, which extends from the top of the hanger body to the support post, is not part of existing standard-type hanger designs, is relatively complex and difficult to mold, and thus adds significant manufacturing costs to the hanger assembly.

Thus, there remains a need in the art to provide an indicator for a standard-type wire hook garment hanger where the indicator is inexpensive to manufacture, and also provides resistance to child tampering while allowing for removal of the indicator.

SUMMARY OF THE INVENTION

It is therefore an object of the invention to provide a garment hanger system with an indicator that is inexpensive to manufacture.

It is another object of the invention to provide such a garment hanger system that does not require complex structures that are difficult to mold.

It is a further object of the invention to provide such a garment hanger system that provides resistance to child tampering while allowing for removal of the indicator and thus reuse of the hanger.

It is also an object of the invention to provide such a garment hanger system wherein the indicator can be removed by manual finger pressure.

It is an additional object of the invention to provide such a garment hanger system in which the indicator attaches to the hanger at its midpoint.

Another object of the invention is to provide an inexpensive indicator for a standard-type wire hook garment hanger where the indicator is resistant to child tampering.

In accord with these objects, which will be discussed in detail below, a garment hanger system includes a hook member, a hanger body, and an information indicator mounted on the hanger body. The hanger body is a standard-type hanger body which includes a reinforcing rib section disposed adjacent a mounting structure that receives a metal hook member. The information indicator is adapted to mount around the hook member and detachably interlock with the reinforcing rib section.

The mechanism that interlocks the indicator to the hanger body in accordance with the present invention is simple to use and very inexpensive to manufacture. It also can be effectively utilized with existing hanger designs.

According to one embodiment of the invention, the information indicator includes a top wall defining a top opening, and at least two sidewalls projecting from the top wall in order to form a hollow cavity therebetween. The sidewalls of the information indicator are adapted (for example, with locking nibs) to detachably interlock to the reinforcing rib section of the hanger body. In this configuration, the opening in the top wall is sized to permit the end of the hook member to pass therethrough such that the indictor can slide down the hook member and interlock with the reinforcing rib section of the hanger body.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
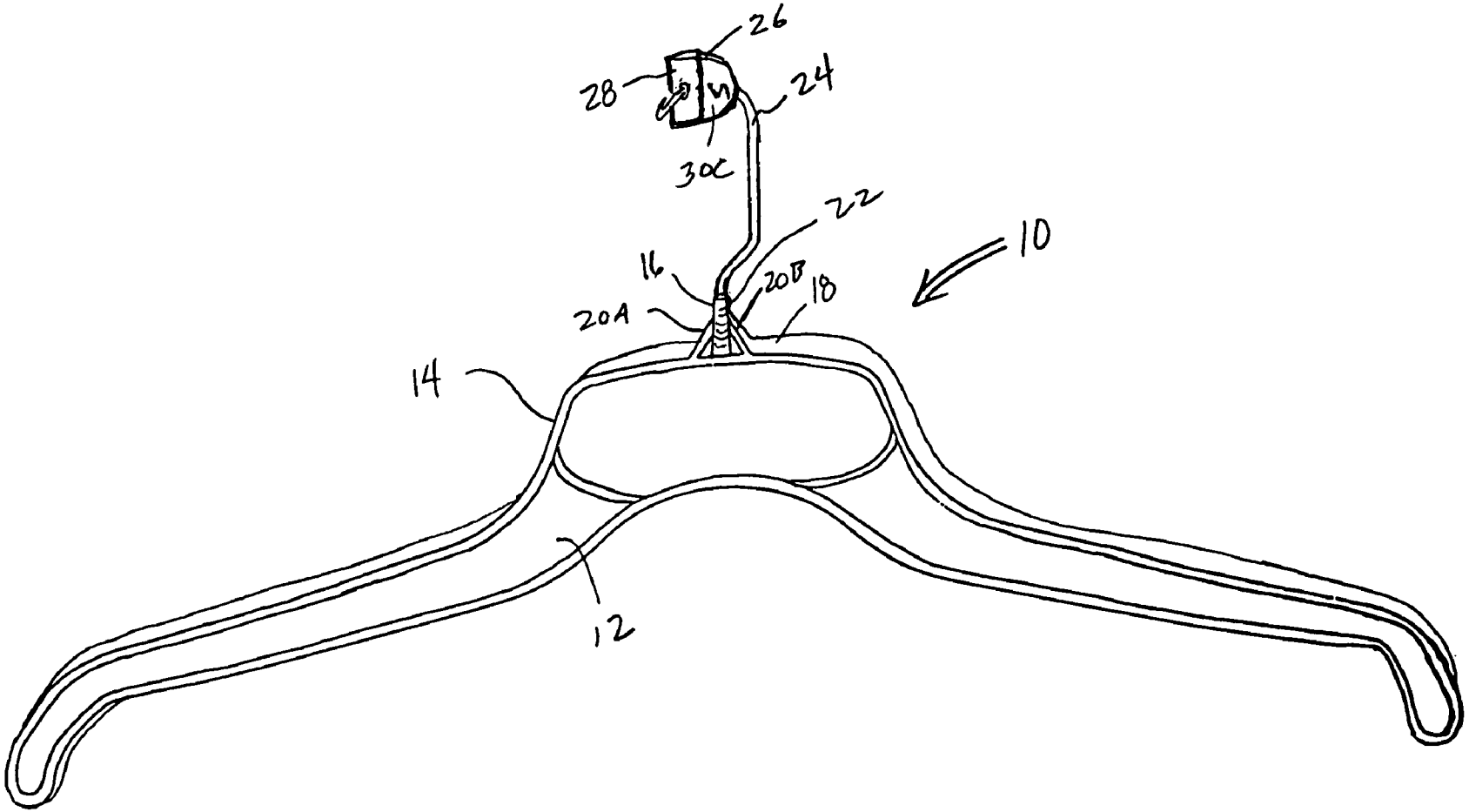
FIG. 1 is a front isometric view of an exemplary garment hanger and sizer in accordance with the present invention, wherein the sizer is being slid over the end of the hook of the garment hanger.

Turning now to FIG. 1, there is shown a garment hanger system 10 in accordance with the present invention, which includes a hanger body 12 that is generally planar and has a transverse reinforcing rib 14 around its periphery to thereby form an I-beam type construction. The hanger body 12 is preferably molded from a thermoplastic material (e.g., K-resin, styrene, polypropylene or other suitable thermoplastic) and has a support post 16 that extends from a section 18 of the reinforcing rib 14 that is disposed at the top of the hanger body 12 near its midpoint as shown. Preferably, the support post 16 includes angled support structures 20A, 20B and a tubular support structure 22 that extends from the reinforcing rib section 18 as shown. The support post structure 16 receives a hook 24. Preferably, the hook 24 is metal and is supported by the support post structure 16 such that it can swivel in a conventional manner without being detachable from the hanger body. Alternatively, the hook 24 may be plastic or other suitable material and may possibly be integrally formed with the hanger body.

As seen in FIGS. 1-5, the hanger body 12 has a length and a width, with the reinforcing rib 14 running lengthwise along the top of the hanger body. As seen best in FIG. 3, the width of the reinforcing rib 14 is wider than the width of the body.

Figure 2:
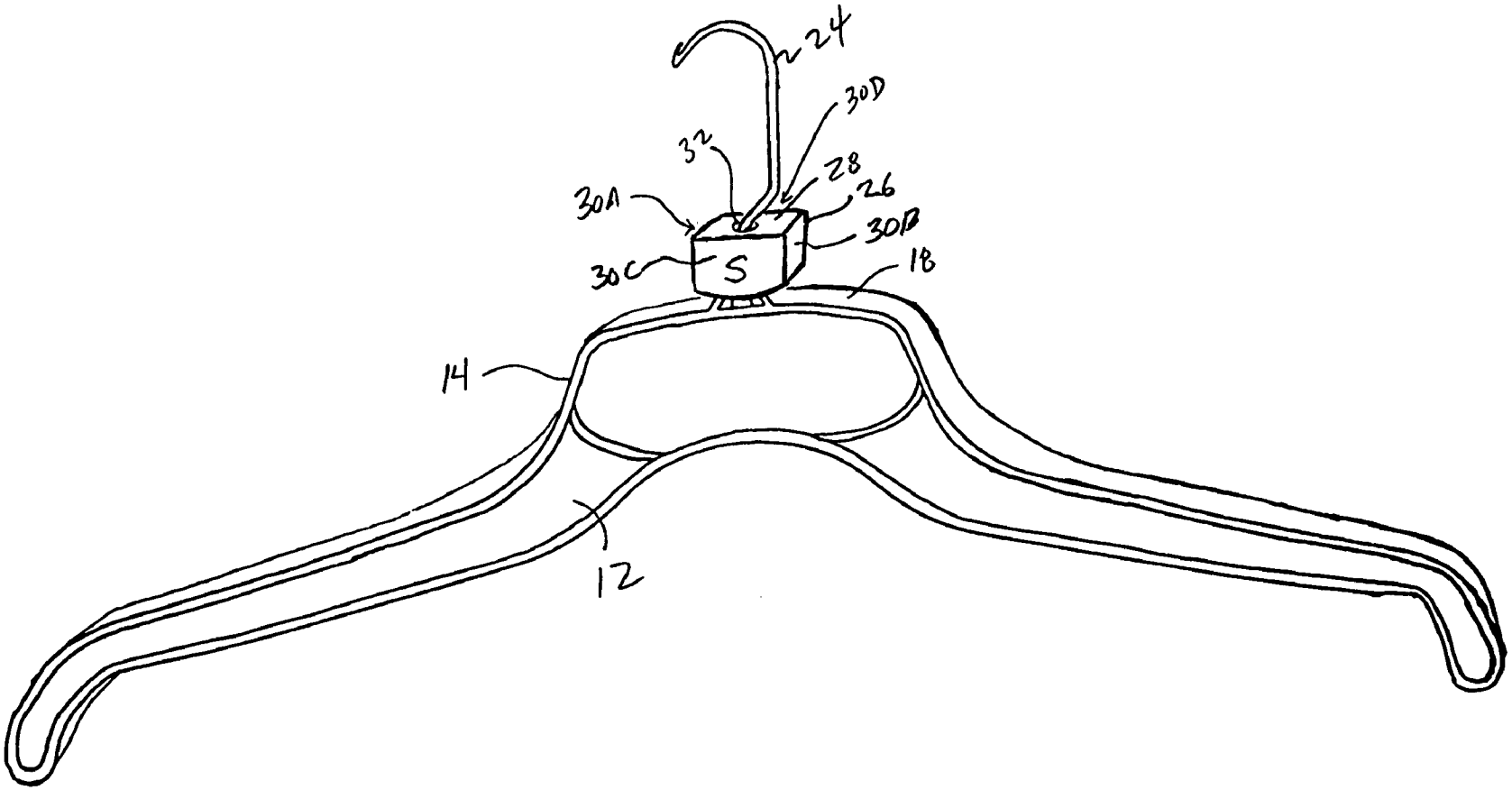
FIG. 2 is a front isometric view of the exemplary garment hanger and sizer of FIG. 1, wherein the sizer has been moved down the hook toward its base.
Figure 3:
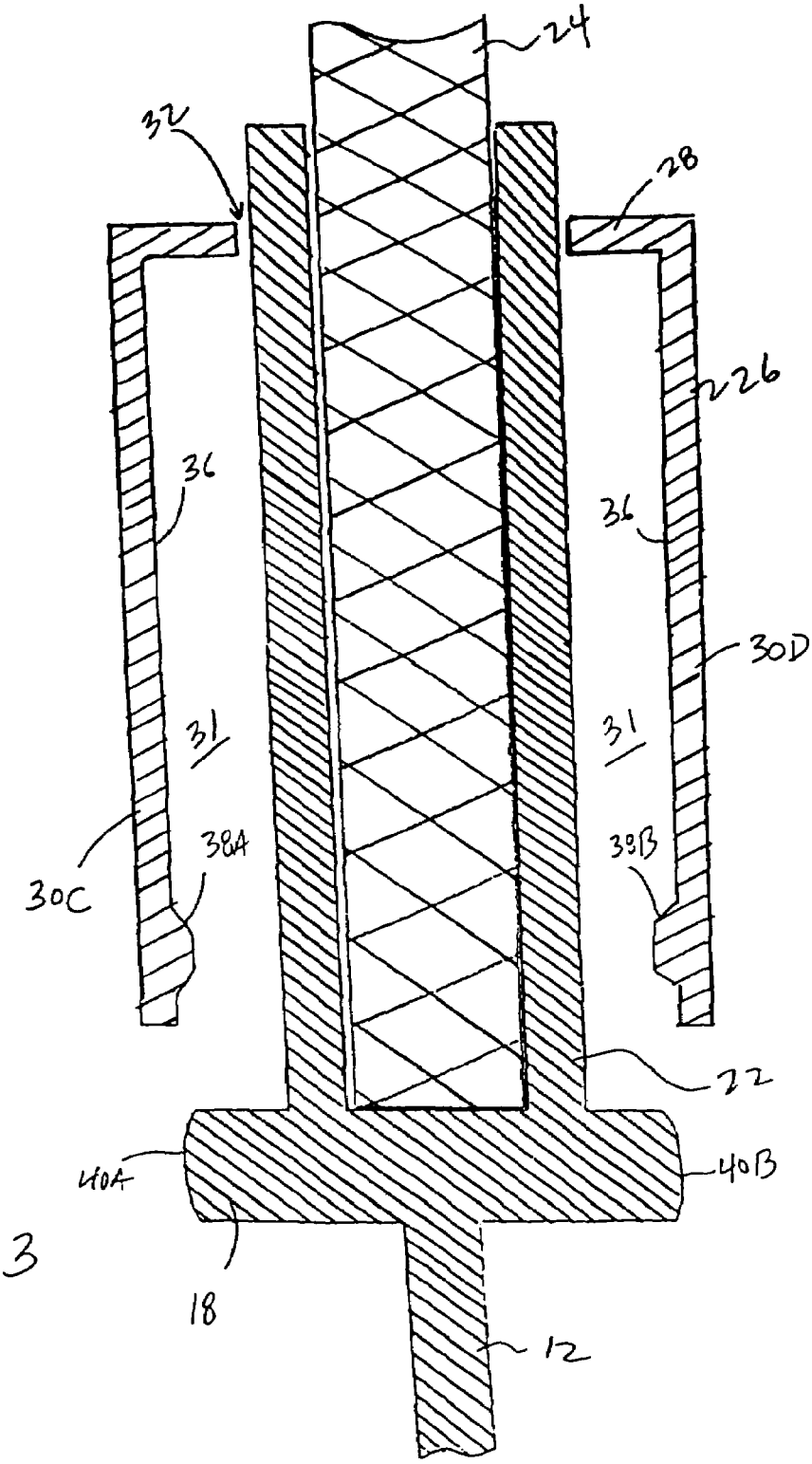
FIG. 3 is a partial cross-sectional view of the hanger body and sizer of FIG. 2, with the sizer positioned near the base of the hook.

A sizer 26 is provided that has a top wall 28 and four sidewalls 30A, 30B, 30C, 30D which extend in perpendicular manner from the edges of the top wall to form a hollow cavity 31 therebetween as best shown in FIGS. 2 and 3. The top wall 28 has a through-opening 32 that is sized to allow the hook 24 to pass through it such that the sizer can slide down the hook as shown in FIG. 1. The exterior surface of one or more of the four sidewalls carries the information (e.g., some attribute of the supported garment, such as the size "S" for small as shown on the wall 30C, quantity, color, etc). Two of the sidewalls 30A, 30B extend in a parallel fashion and have respective widths that substantially correspond to the width of the reinforcing rib section 18 as best shown in FIG. 2. The other two sidewalls 30C, 30D extend in a parallel fashion along a plane perpendicular to the planes of the sidewalls 30A, 30B. The interior surfaces 36 of the two sidewalls 30C, 30D have locking nibs 38A, 38B (e.g., a projection) as shown in FIG. 3.

Figure 4:
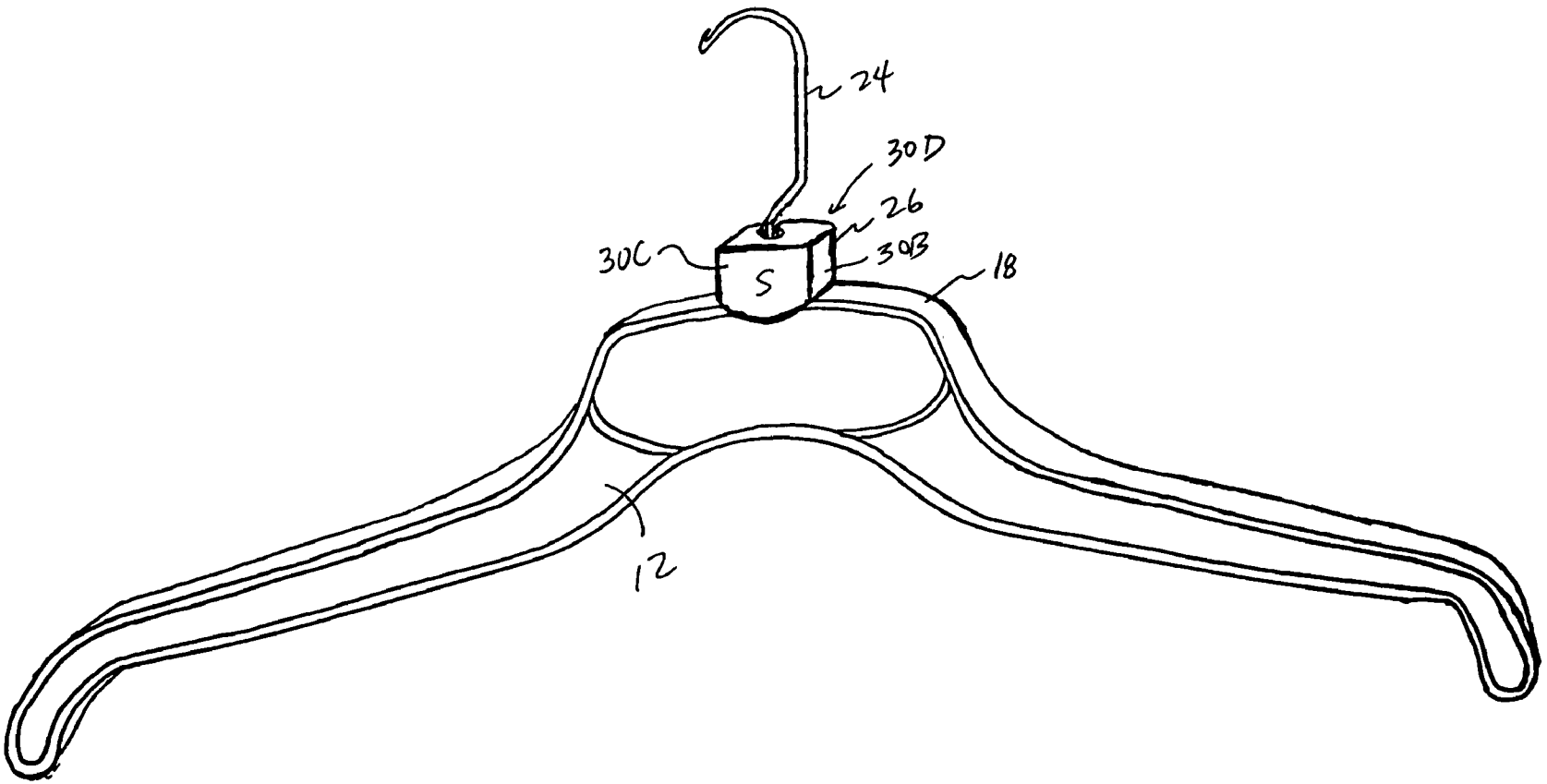
FIG. 4 is a front isometric view of the exemplary garment hanger and sizer of FIG. 1, wherein the sizer has been mounted onto the hanger body.

As shown in FIGS. 1-3, the sizer 26 is passed over the end of the hook 24 and down the length of the hook 24. The sizer 26 is then positioned such that the locking nibs 38A, 38B pass over and detachably interlock with the opposing sides 40A, 40B of the rib section 18 of the hanger body 12 as shown in FIGS. 4 and 5.

Figure 5:
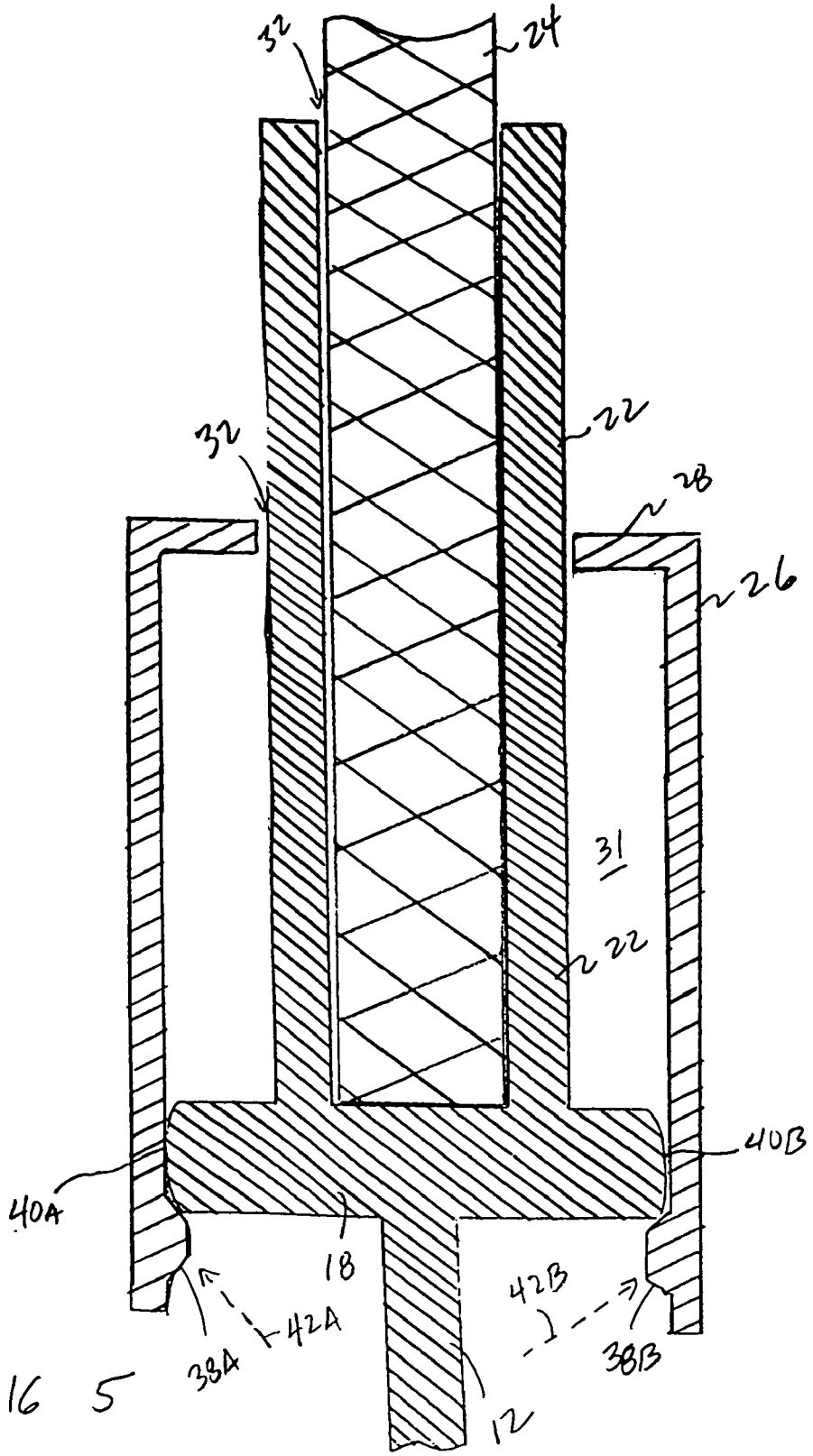
FIG. 5 is a partial cross-sectional view of the hanger body and sizer of FIG. 4, with the sizer mounted onto the hanger body.

Preferably, the sizer 32 is detached from the rib section 18 by manual finger pressure that forces one or more of the sidewalls outward away from the rib section 18 and upward toward the metal hook as shown by the dotted arrows 42A, 42B in FIG. 5. In the embodiment shown, when the sizer 32 is twisted, the curved bottom surface of the sidewalls 30A, 30C acts as an inclined ramp which causes the sizer to move upward and at the same time slightly spreading the sidewalls 30A, 30C away from one another. This action allows the interlocking nibs 38A, 38B to disengage from the rib section 18 of the hanger body. The size of the locking nibs 38A, 38B and/or the flexibility of the sizer 26 are adapted such that the manual finger pressure required for removal of the sizer 26 is difficult to achieve. In this manner, the sizer 26 is made resistant to child tampering.

Preferably, the travel of the locking nibs 38A, 38B with respect to the rib section 18 is controlled by a stop surface that is part of the sizer 26. In this manner, the locking nibs 38A, 38B can be controlled to rest near (or up against) the rib section 18 in the interlocked position as shown in FIG. 5. In the configuration shown, the stop surface is provided by the sidewalls 30A, 30B whereby the bottoms of the sidewalls 30A, 30B contact the top of the rib section 18. In this configuration, the vertical offset between the bottom of the sidewalls 30A, 309B and the locking nibs 308A, 38B is selected such that the nibs rest near (or up against) the rib section 18 in the interlocked position (FIG. 5).

Alternatively, the stop surface may be provided by the support post. For example, the stop surface may be provided by the angled supports 20A, 20B (FIG. 1) whereby the bottom side of the top wall 28 of the sizer 26 contacts the angled supports 20A, 20B. In this configuration, the distance between the bottom side of the top wall 28 and the locking nibs 38A, 38B of the sizer corresponds to the distance between the stop surface (which is part of the angled supports) and the rib section 18 of the hanger body 12 such that the nibs rest near (or up against) the rib section in the interlocked position (FIG. 5).

Preferably, the sizer 26 is formed by injection molding a thermoplastic material. The opening 32 in the top wall 28 may be formed as part of the mold or subsequent thereto by drilling, by punching the top wall 28 while the thermoplastic material is semi-molten, or by other suitable means.

Advantageously, the innovative mechanism that interlocks the indicator to the hanger body as described herein is simple to use and very inexpensive to manufacture. It also can be used in conjunction with standard-type hangers already common in the art.

Figure 6:
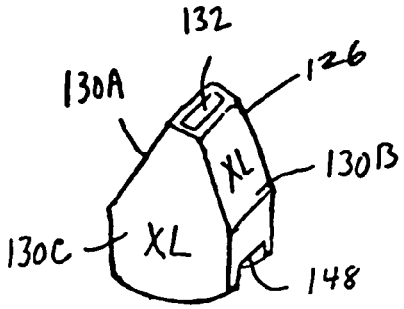
FIG. 6 is a perspective view of a second embodiment of the sizer of the invention.
Figure 7:
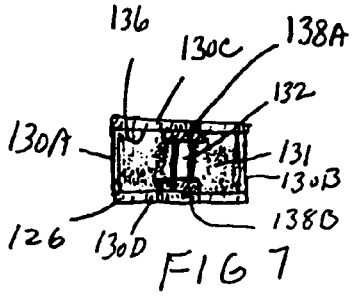
FIG. 7 is a bottom view of the second embodiment of the sizer of FIG. 6.

Turning now to FIGS. 6 and 7, a second embodiment of a sizer 126 in accordance with the present invention is seen. Sizer 126 includes four sidewalls 130A, 130B, 130C, 130D which define between them a hollow cavity 131 which leads to a rectangular top opening 132. The top opening is sized to allow a hook to pass through it such that the sizer can be slid over the end of the hook and down the hook to the hanger body. The exterior surface of one or more of the four sidewalls carries size or other information. Two of the sidewalls 130C, 130D extend in a parallel fashion and are spaced apart (by sidewalls 130A and 130B) to substantially correspond to the width of the reinforcing rib section of the hanger. Sidewalls 130C and 130D taper in length as they extend downward (i.e., length of sidewalls 130C and 130D is larger at the bottom than at the top). The other two sidewalls 130A, 130B preferably extend in a non-parallel fashion relative to each other such that at least a portion of the sidewalls 130A, 130B is preferably angled at an angle similar to angled support structures 20A, 20B. However, sidewalls 130A, 130B are preferably generally perpendicular to the planes of the sidewalls 130C, 130D. Thus, a cross-section through the four walls of the sizer 126 generally provides a rectangle; although if desired, the sidewalls 130A, 130B can be bowed such that a cross-section would be oblong.

As seen in FIG. 7, the interior surfaces 136 of the two sidewalls 130C, 130D have locking nibs 138A, 138B (e.g., a projection). Sizer 126 is arranged such that when the locking nibs 138A, 138B are locked to the reinforcing rib section of the hanger, the tops of the sidewalls extend above the tubular support structure for the metal hook.

As with the embodiment of FIGS. 1-5, the travel of the locking nibs 138A, 138B with respect to the rib section of the hanger body is controlled by a stop surface that is part of the sizer 126. In this manner, the locking nibs 138A, 138B can be controlled to rest near (or up against) the rib section in an interlocked position. In one arrangement, the stop surface is provided by the sidewalls 130A, 30B whereby the bottoms 148 of the sidewalls 130A, 130B contact the top of the rib section. In this configuration, the vertical offset between the bottom 148 of the sidewalls 130A, 130B and the locking nibs 138A, 138B is selected such that the nibs rest near (or up against) the rib section in the interlocked position. Alternatively, although less preferred, the stop surface may be provided by the support post itself. For example, the stop surface may be provided by the top of post 16 (FIG. 1) whereby the inside of the angled walls 130C, 130D contact the top of post 16 at or near the opening 132.

Preferably, the sizer 126 is formed by injection molding a thermoplastic material.

Figure 8:
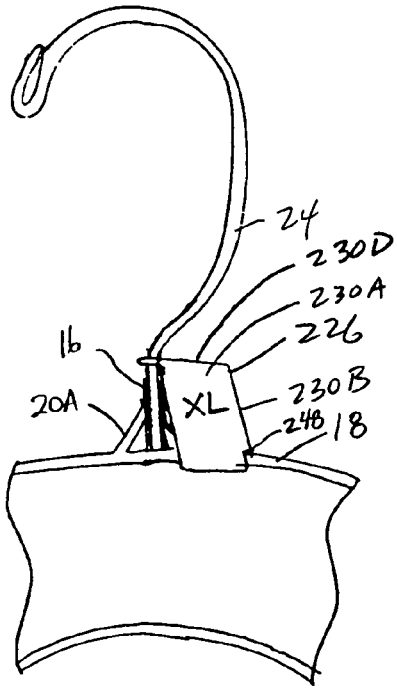
FIG. 8 is a front isometric view of an alternate embodiment of a garment hanger and sizer in accordance with the present invention.
Figure 9:
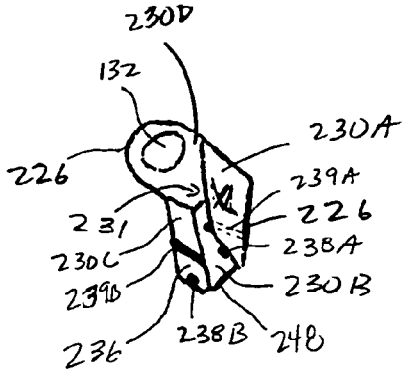
FIG. 9 is a bottom perspective view of the sizer of FIG. 8.

Turning now to FIGS. 8 and 9, a third embodiment of a sizer 226 in accordance with the present invention is seen. Sizer 226 includes three sidewalls 230A, 230B, 230C and a top wall 230D. The top wall 230D has an extension that defines an opening 231 which is sized such that the sizer can be slid over the end of the hook and down the hook to the hanger body. The sidewalls and the top wall define between them a cavity 231 which opens to the top opening 132. Two of the sidewalls 230A, 230C extend in a parallel fashion and are spaced apart (by sidewall 230B) to substantially correspond to the width of the reinforcing rib section 18 of the hanger.

Preferably, the two sidewalls 230A and 230C extend at an angle relative to the support post 16 of the hanger body such that sizer 226 is disposed to the side of the support post 16 as shown. Alternatively, the two sidewalls 230A, 230C may be adapted to surround the support post 16.

As seen in FIG. 9, the interior surfaces 236 of the two sidewalls 230A, 230C have locking nibs 238A, 238B (e.g., a projection). Sizer 226 is arranged such that when the locking nibs 238A, 238B are locked to the reinforcing rib section of the hanger, the top wall 230D is positioned above the tubular support post 16 for the metal hook. Also, as seen in FIG. 9, the interior surfaces 236 of the two sidewalls 230A, 230C have ribs 239A, 239B which extend along a direction substantially parallel to the top wall 230D and act as stabilizers. These stabilizing ribs 239A, 239B contact one of the support structures (e.g., 20B) and prevents otherwise easy removal of the sizer simply by squeezing the sidewalls 230A, 230B to release the locking nibs.

As with the embodiment of FIGS. 1-5, the travel of the locking nibs 238A, 238B with respect to the rib section of the hanger body is controlled by a stop surface that is part of the sizer 226. In this manner, the locking nibs 238A, 238B can be controlled to rest near (or up against) the rib section in an interlocked position. In one arrangement, the stop surface is provided by the sidewall 230B whereby the bottom 248 of the sidewall 230B contacts the top of the rib section. In this configuration, the vertical offset between the bottom 248 of the sidewall 230B and the locking nibs 238A, 238B is selected such that the nibs rest near (or up against) the rib section in the interlocked position. Alternatively, although less preferred, the stop surface may be provided by the support post itself. For example, the stop surface may be provided by the top of post 16 (FIG. 8) where it contacts the top wall 230D of the sizer 226 at or near the opening 132.

Preferably, the sizer 226 is formed by injection molding a thermoplastic material.

There have been described and illustrated herein several embodiments of a garment hanger system with a size indicator. While particular embodiments of the invention have been described, it is not intended that the invention be limited thereto, as it is intended that the invention be as broad in scope as the art will allow and that the specification be read likewise. Thus, while particular projection-based interlocking mechanisms have been disclosed, it will be appreciated that other types of interlocking mechanisms, such as barbs, ridges, snap-fit constructs, or other suitable internal constructs, can be used as well. In addition, while a particular type of hanger body has been disclosed, it will be understood other hanger body types, such as clamp-type hanger body types, can be used. Also, while it is preferred that the sizer be slid over the end of the hook through an opening in sizer, it will be recognized that the sizer can readily be adapted such it has a lengthwise slot that allows for insertion of the hook therein. In this configuration, the sizer is installed by inserting the hook into the lengthwise slot. Also, while removal of the sizer by manual finger pressure is preferred, it will be recognized that a tool can be used to assist in disengaging the locking mechanism that holds the sizer in place. Moreover, while particular geometries, shapes and configurations have been disclosed in reference to the hanger body and the sizer, it will be appreciated that other configurations could be used as well. In addition, while the sizer(s) described herein may be singularly provided with a hanger body, it will be appreciated that the sizer may be pre-mounted on the hanger body for sale to a retailer, and sets of sizers and one or more hanger bodies may be sold as a kit. It will therefore be appreciated by those skilled in the art that yet other modifications could be made to the provided invention without deviating from its spirit and scope as claimed.

What is claimed is:

1. A garment hanger comprising:

a hook member;

a hanger body from which said hook member extends, said hanger body having a length and a width and a reinforcing rib section disposed along a top of said hanger body and adjacent said location from which the hook member extends, said reinforcing rib section running in a direction of said length and being wider than said width; and an information indicator that is adapted to mount around said hook member and detachably interlock with said reinforcing rib section, said information indicator defining an opening through which the hook member passes in order to mount said information indicator, said information indicator having a top wall with sidewalls that project therefrom to form a hollow cavity therebetween, said sidewalls including first and second sidewalls adapted to detachably interlock with said reinforcing rib section and each having an interior surface with an interlocking nib that passes over and interlocks with said reinforcing rib, and said sidewalls including third sidewall and a fourth sidewall having respective widths that correspond to a width of said reinforcing rib section.

2. A garment hanger according to claim 1, wherein:

bottom surfaces of said third sidewall and said fourth sidewall are adapted to limit travel of said information indicator such that said interlocking nibs rest adjacent said rib section in an interlocked position during use.

3. A garment hanger comprising:

a hook member;

a hanger body from which said hook member extends said hanger body having a length and a width and a reinforcing rib section disposed along a top of said hanger body and adjacent said location from which the hook member extends said reinforcing rib section running in a direction of said length and being wider than said width; and an information indicator that is adapted to mount around said hook member and detachably interlock with said reinforcing rib section said information indicator defining an opening through which the hook member passes in order to mount said information indicator, said information indicator including a top wall and three sidewalls projecting therefrom to form a hollow cavity therebetween, wherein two of said three sidewalls are adapted to detachably interlock with said reinforcing rib section with a respective interlocking nib that is disposed on an interior surface and passes over and interlocks with said reinforcing rib.

4. A garment hanger comprising:

a hook member;

a hanger body from which said hook member extends, said hanger body having a length and a width and a reinforcing rib section disposed along a top of said hanger body and adjacent said location from which the hook member extends said reinforcing rib section running in a direction of said length and being wider than said width; and an information indicator that is adapted to mount around said hook member and detachably interlock with said reinforcing rib section, said information indicator defining an opening through which the hook member passes in order to mount said information indicator, said information indicator including a top wall and sidewalls projecting therefrom to form a hollow cavity therebetween, said sidewalls including first and second sidewalls adapted to detachably interlock with said reinforcing rib section and each having an interior surface with an interlocking nib that passes over and interlocks with said reinforcing rib, and said interior surfaces of said first and second sidewalls have stabilizing ribs that extend in a direction parallel to said top wall.

5. A garment hanger comprising:

a hook member;

a hanger body from which said hook member extends said hanger body having a length and a width and a reinforcing rib section disposed along a top of said hanger body and adjacent said location from which the hook member extends said reinforcing rib section running in a direction of said length and being wider than said width and said hanger body having angled supports and a tubular support that extend from said reinforcing rib section; and an information indicator that is adapted to mount around said hook member and detachably interlock with said reinforcing rib section.

6. A garment hanger according to claim 5, wherein:

said angled supports limit travel of said information indicator such that the interlocking nibs rest adjacent said reinforcing rib section in an interlocked position during use.

7. A garment hanger comprising:

a hook member;

a hanger body from which said hook member extends, said hanger body comprising a molded plastic material and having a length and a width and a reinforcing rib section disposed along a top of said hanger body and adjacent said location from which the hook member extends, said reinforcing rib section running in a direction of said length and being wider than said width; and an information indicator that is adapted to mount around said hook member and detachably interlock with said reinforcing rib section, said information indicator defining an opening through which the hook member passes in order to mount said information indicator, said information indicator including at least three sidewalls forming therebetween a hollow cavity, a first and a second of said at least three sidewalls adapted to detachably interlock with said reinforcing rib section, and a third sidewall of said at least three sidewalls has a respective width that corresponds to a width of said reinforcing rib section.

8. A garment hanger according to claim 7, wherein:

a bottom surface of said third sidewall is adapted to limit travel of said information indicator such that said interlocking nibs rest adjacent said rib section in an interlocked position during use.

9. A kit comprising:

a hook member;

a hanger body from which said hook member extends, said hanger body having a length and a width and a reinforcing rib section disposed along a top of said hanger body and adjacent a mounting structure that receives said hook member, said reinforcing rib section running in a direction of said length and being wider than said width; and a plurality of information indicators each adapted to mount one at a time around said hook member and detachably interlock with said reinforcing rib section and each defining an opening through which the hook passes in order to mount the respective information indicator and each including a top wall and sidewalls projecting therefrom to form a hollow cavity therebetween, said sidewalls including first and second sidewalls adapted to detachably interlock with said reinforcing rib section said first and second sidewalls each having an interlocking nib that passes over and interlocks with said reinforcing rib section and said sidewalls including a third sidewall having a width that corresponds to a width of said reinforcing rib section.

10. A kit according to claim 9, wherein:

a bottom surface of said third sidewall is adapted to limit travel of each said information indicator such that the interlocking nibs rest adjacent said reinforcing rib section in an interlocked position during use.

11. A kit comprising:

a hook member;

a hanger body from which said hook member extends, said hanger body having a length and a width and a reinforcing rib section disposed along a top of said hanger body and adjacent a mounting structure that receives said hook member, said reinforcing rib section running in a direction of said length and being wider than said width, and said hanger body having angled supports and a tubular support that extend from said reinforcing rib section; and a plurality of information indicators each adapted to mount one at a time around said hook member and detachably interlock with said reinforcing rib section.

12. A kit according to claim 11, wherein:

said angled supports limit travel of each said information indicator such that the interlocking nibs rest adjacent said reinforcing rib section in an interlocked position during use.

13. A kit comprising:

a hook member;

a hanger body from which said hook member extends said hanger body having a length and a width and a reinforcing rib section disposed along a top of said hanger body and adjacent a mounting structure that receives said hook member, said reinforcing rib section running in a direction of said length and being wider than said width; and a plurality of information indicators each adapted to mount one at a time around said hook member and detachably interlock with said reinforcing rib section and each defining an opening through which the hook member can pass in order to mount said respective information indicator and each including at least three sidewalls forming therebetween a hollow cavity a first and a second of said at least three sidewalls adapted to detachably interlock with said reinforcing rib section and having an interlocking nib that passes over and interlocks with said reinforcing rib, and a third sidewall of said at least three sidewalls having a width that corresponds to a width of said reinforcing rib section.

* * * * *